US010150635B2

(12) United States Patent
Jerry et al.

(10) Patent No.: US 10,150,635 B2
(45) Date of Patent: Dec. 11, 2018

(54) EDGE CONTACT SUBSTRATE TRANSPORT METHOD AND APPARATUS

(71) Applicant: 3M INNOVATIVE PROPERTIES COMPANY, St. Paul, MN (US)

(72) Inventors: Glen A. Jerry, Blaine, MN (US); Ameeta R. Goyal, Woodbury, MN (US); Ronald P. Swanson, Woodbury, MN (US); James N. Dobbs, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/523,574

(22) PCT Filed: Dec. 16, 2015

(86) PCT No.: PCT/US2015/066069

§ 371 (c)(1),
(2) Date: May 1, 2017

(87) PCT Pub. No.: WO2016/106043

PCT Pub. Date: Jun. 30, 2016

(65) Prior Publication Data

US 2017/0305700 A1 Oct. 26, 2017

Related U.S. Application Data

(60) Provisional application No. 62/096,497, filed on Dec. 23, 2014.

(51) Int. Cl.
*B05B 13/02* (2006.01)
*B65H 23/025* (2006.01)

(52) U.S. Cl.
CPC ..... *B65H 23/0258* (2013.01); *B05B 13/0207* (2013.01); *B05B 13/0221* (2013.01);
(Continued)

(58) Field of Classification Search
CPC .. B65H 23/0258; B65H 23/038; B65H 20/02; B65H 20/04; B65H 2301/5114;
(Continued)

(56) References Cited

U.S. PATENT DOCUMENTS 3,265,272 A 8/1966 Smith
3,414,954 A 12/1968 Alexeff
(Continued)

FOREIGN PATENT DOCUMENTS

CA 2214486 A1 * 3/1998 ..... B41F 23/0423
CN 102883876 A 1/2013
(Continued)

OTHER PUBLICATIONS

International Search report on international Application No. PCT/US2015/66069 dated Mar. 7, 2016, 3 pages.

*Primary Examiner* — William E Dondero
(74) *Attorney, Agent, or Firm* — James A. Baker

(57) ABSTRACT

A web path for conveying a web material includes at least two support rollers contacting a single major surface of the web material, wherein the web material is of indefinite length and has a first and a second edge. A first support roller contacts a first edge region of the web material, and a second support roller contacts a second edge region of the web material such that the web material has a substantial uncontacted region between the first and the second support roller including at least about 50% of the width of the web material. At least one of the first support roller and the second support roller are supported on a bowed shaft such that at least one of the first and second support rollers is angled with respect to the direction of motion of the web.

16 Claims, 10 Drawing Sheets

(52) U.S. Cl.
CPC .. *B65H 2301/5114* (2013.01); *B65H 2601/25* (2013.01); *B65H 2601/2532* (2013.01); *B65H 2701/132* (2013.01)

(58) Field of Classification Search
CPC ..... B65H 2601/25; B65H 2601/2532; B65H 2701/132; B65H 2701/1315
See application file for complete search history.

(56) References Cited

U.S. PATENT DOCUMENTS

| | | | |
|---|---|---|---|
| 5,273,197 | A | 12/1993 | Wenk |
| 5,302,975 | A | 4/1994 | Whritenor |
| 5,729,878 | A | 3/1998 | Kurihara |
| 2008/0081164 | A1 | 4/2008 | Swanson |
| 2009/0212494 | A1 | 8/2009 | Maeyama |
| 2010/0054826 | A1 | 3/2010 | Hieda |
| 2013/0241141 | A1 | 9/2013 | Karikusa |

FOREIGN PATENT DOCUMENTS

| | | |
|---|---|---|
| DE | 1803860 | 5/1970 |
| DE | 2430298 | 8/1976 |
| GB | 1532635 | 11/1978 |
| WO | WO 2011-142712 | 11/2011 |

* cited by examiner

EDGE CONTACT SUBSTRATE TRANSPORT METHOD AND APPARATUS

CROSS REFERENCE TO RELATED APPLICATIONS

This application is a national stage filing under 35 U.S.C. 371 of PCT/US2015/066069, filed Dec. 16, 2015, which claims the benefit of U.S. Application No. 62/096,497, filed Dec. 23, 2014, the disclosure of which is incorporated by reference in its/their entirety herein.

BACKGROUND

In general, a functional film can be made on a process line by delivering an uncoated web material, applying a coating composition to the web material, and performing drying or other treatment steps to process the coating composition to form a coating layer on the web material. The coating composition is often not coated across the full width of the web material, and the uncoated margins are eventually cut off prior to winding up the coated web product.

Rollers can be utilized to convey the web material on the process line. Thin web substrate materials can be particularly difficult to transport over or between the rollers on the process line without causing wrinkles, kinks, bagginess, and the like, and such defects can significantly reduce the value of the coated web product. In addition, passing very thin or delicate coatings over and through rollers can damage the coating layer, which also reduces the value of the coated web product to a potential customer.

Reducing frictional force at an interface between the surface of the rollers and the surface of the web material can be helpful in reducing these types of defects. For example, reducing the tension on the web substrate material, changing the material on the surfaces of the rollers that contacts the web substrate (for example, using o-rings or sleeves on the contacting surfaces of the rollers), and reducing the wrap angle at which the web substrate contacts the roller have been employed.

SUMMARY

Reducing frictional force between the surfaces of the rollers and the web substrate material can in some circumstances reduce defects in coated web products that have thin substrates and thin or delicate coatings. However, reduced frictional force at the roller-web interface can require reduced web transport speeds to keep the web and the roller in traction with one another. Reduced friction at the roller-web interface can also be ineffective to prevent damage to the coating layer if the coating layer or the web substrate is extremely thin, delicate or highly reactive. Reduced friction at the roller-web interface can also undesirably limit options for processing the coating layer, or options for design of the coating apparatus and coating line.

In general, the present disclosure is directed to a method and apparatus for transporting a web substrate material over an arrangement of at least two rollers in which the rollers contact the web substrate material only at opposed edges thereof, and wherein at least one of the rollers is angled outwardly with respect to a direction of web travel. Positioning the rollers at opposed edges of the web substrate material leaves a center region of the web substrate material between the opposed edges that is un-contacted by the rollers and remains substantially unsupported by the rollers. In some embodiments the substantial un-contacted region of the web material minimizes the potential for damage to or contamination of sensitive coating layers and reduces the amount of the web substrate material trimmed away and discarded prior to shipping the coated web product to a customer. In various embodiments, the angled rollers can more reliably maintain commercially useful web tension on the web processing line compared to rollers with o-rings and sleeves, and in some embodiments can transport delicate web substrate materials at very low levels of tension without damage such as wrinkling, kinking, creasing, and the like. In some embodiments, the rollers contact only a single side of the web substrate (either the coated face side or the uncoated back side) at the opposed edges thereof, which can also reduce the potential for damage to sensitive coatings or thin web substrate materials.

In one aspect, the present disclosure is directed to a web path for conveying a web material, including:

at least two support rollers contacting a single major surface of the web material, wherein the web material is of indefinite length and has a first and a second edge, the support rollers comprising:

a first support roller contacting a first edge region of the web material, and a second support roller contacting a second edge region of the web material, wherein the web material comprises an un-contacted region between the first and the second support roller comprising at least about 50% of the width of the web material; and wherein at least one of the first support roller and the second support roller are supported on a bowed shaft such that at least one of the first and second support rollers is angled with respect to the direction of motion of the web material.

In another aspect, the present disclosure is directed to an apparatus for transporting a web material. The apparatus includes a least two support rollers, wherein a first support roller engages a first edge region of a first side of the web material having a length substantially greater than the width thereof, and a second support roller engages a second edge region of the first side of the web material, and wherein each of the rollers has a width that is substantially less than the width of the web material. Each of the support rollers is rotatable on a bowed shaft, and at least one of the support rollers is at an angle θ in a plane x-y with respect to a direction x normal to a longitudinal axis y of the shafts, and wherein the angle θ is greater than about 0° and less than about 6°.

In another aspect, the present disclosure is directed to a method, including:

engaging a first edge region on a first side of a web material with a first support roller, wherein the first support roller is rotatable on a first end of a shaft, and wherein the web material has a length substantially greater than the width thereof;

engaging a second edge region on the first side of the web material with a second support roller, wherein the second support roller is rotatable on a second end of the shaft opposite the first end thereof, and wherein a central region between the first roller and the second roller and comprising at least about 80% of a width of the web material is free of support from a roller;

wrapping the web material about the first roller and the second roller at an angle of about 90° to about 230°; and orienting at least one of the support rollers at an angle θ in a first plane x-y with respect to a direction x normal to a longitudinal axis y of the shaft, wherein the angle θ is greater than about 0° and less than about 6°.

In yet another aspect, the present disclosure is directed to a method for coating a web material. The method includes:

engaging a first edge region on a first side of the web material with a first support roller, wherein the first support roller is rotatable on a first end of a shaft, and wherein the web material has a length substantially greater than the width thereof;

engaging a second edge region on the first side of the web material with a second support roller, wherein the second support roller is rotatable on a second end of the shaft opposite the first end thereof, and wherein a central region including at least about 80% of a width of the web material between the first roller and the second roller is free of support from a roller;

bowing the shaft an amount sufficient to orient the first and the second support rollers at an angle θ in a first plane x-y with respect to a direction x normal to a longitudinal axis y of the shaft, wherein the angle θ is greater than about 0° and less than about 6°;

transporting the web material over the first and the second support rollers;

applying a coating composition to a second side of the web material opposite the first side; and processing the coating composition to form a coating layer on the second side of the web material.

In yet another aspect, the present disclosure is directed a web path for conveying a web material, including:

at least two support rollers contacting a single major surface of the web material, wherein the web material is of indefinite length and has a first and a second edge, and wherein the web material wraps about the support rollers at a wrap angle of about 90° to about 230°, the support rollers including:

a first support roller contacting a first edge region of the web material, and a second support roller contacting a second edge region of the web material opposite the first edge, such that the web material comprises a substantial un-contacted region between the first and the second support roller comprising at least about 50% of the width of the web material; and wherein at least one of the first support roller and the second support roller are angled with respect to the direction of motion of the web.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like symbols in the drawings indicate like elements.

DETAILED DESCRIPTION

Figure 1:
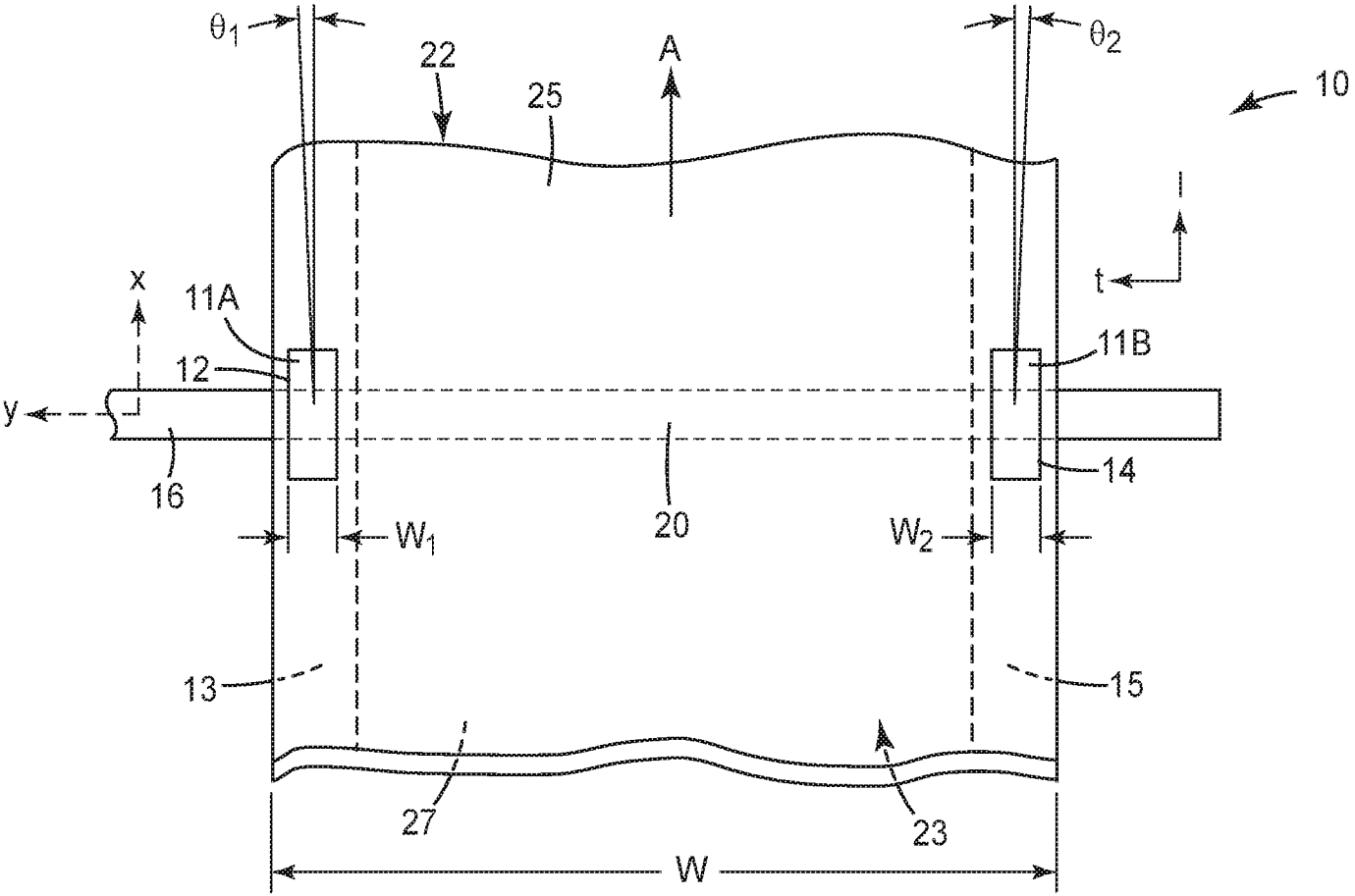
FIG. 1 is a schematic overhead view of an embodiment of a web handling apparatus.

Referring to FIG. 1, a schematic overhead view of a web handling apparatus 10 includes at least two rollers 12, 14 that rotate about their respective shafts 16, 18. In various embodiments, the rollers 12, 14 may turn on roller bearings on the shafts 16, 18, or may be driven on the shafts 16, 18. In some embodiments, the rollers may rotate about a single shaft 20. At least one of the rollers 12, 14 in the web handling apparatus 10 is "toed outward" and positioned at an angle θ in a plane x-y with respect to a direction x normal to a longitudinal axis y of the shafts 16, 18. In the embodiment of FIG. 1, the roller 12 is angled at an angle $\theta_1$ and the roller 14 is angled at an angle $\theta_2$ with respect to the direction x. In various embodiments, it is not necessary that $\theta_1=\theta_2$, and $\theta_1$ and $\theta_2$ can be independently selected from greater than about 0° to about 6°, or greater than about 0 to about 2°, or greater than about 0° to about 1°, or about 0.2° to about 0.8°.

A web material 22 with a length l substantially longer than its width w moves along its length l in the direction of arrow A and traverses the rollers 12, 14. The rollers 12, 14 have widths $w_1$, w2 that are each substantially smaller than the width w of the web material 22. In the embodiment of FIG. 1 the rollers 12, 14 contact a surface of a first underside 23 of the web substrate material 22, but in other embodiments may contact an opposed surface of a second upper side 25 of the web substrate material 22. In some embodiments of the nip roller arrangements shown below, the rollers 12, 14 may contact both sides 23, 25 of the web substrate material 22. The surfaces 11A, 11B of the rollers 12, 14 contacting the web material 22 can be independently selected from a wide range of materials including, but not limited to, natural and synthetic rubber, silicone, polymeric materials, metals, and the like. In some embodiments, the surfaces 11A, 11B of the rollers 12, 14 can include o-rings or sleeves to modify the coefficient of static friction at an interface with the web material 22.

The rollers 12, 14 contact at least a portion of opposed edges 13, 15 of the surface of the first side 23 of the web substrate material 22. A center region 27 of the first side 23 of the web material 22 does not contact the rollers 12, 14 and remains unsupported by any roller. In various embodiments, the opposed edges 13, 15 of the web substrate material 22 can be independently selected to be substantially the same width as the rollers 12, 14 and, depending on the intended application, can be substantially wider. In various embodiments, the center region of the first side 23 of the web material 22 is about 50% to about 98% of the width w of the web substrate material 22, or about 70% to about 95%, or about 80% to about 90%, of the width w. While not wishing to be bound by any theory, presently available evidence indicates that the toed outward orientation of at least one of the rollers gently pulls the web material 22 in a transverse direction t normal to its length l, which maintains tension in the web material 22 and helps to maintain sufficient engagement between the rollers 12, 14 and the opposed edges 13, 15 to transport the web material 22.

In some embodiments, the reduced amount of contact between the rollers and the surface of the web material in the web handling apparatuses described herein can reduce or substantially prevent damage to sensitive or thin web materials or coating layers, and in some embodiments may also reduce or substantially prevent contamination of delicate or highly reactive coating layers applied on the web material. The apparatuses described herein have a relatively small camber or "toe-out" compared to rollers in conventional web handling systems, which in some embodiments can transport very thin or sensitive web materials without damage.

In some embodiments, the apparatuses described herein can be used re-thread a web material at lower tension levels than conventional web handling devices, and can also potentially be used to gently remove creases or wrinkles in damaged web materials.

Figure 2A:
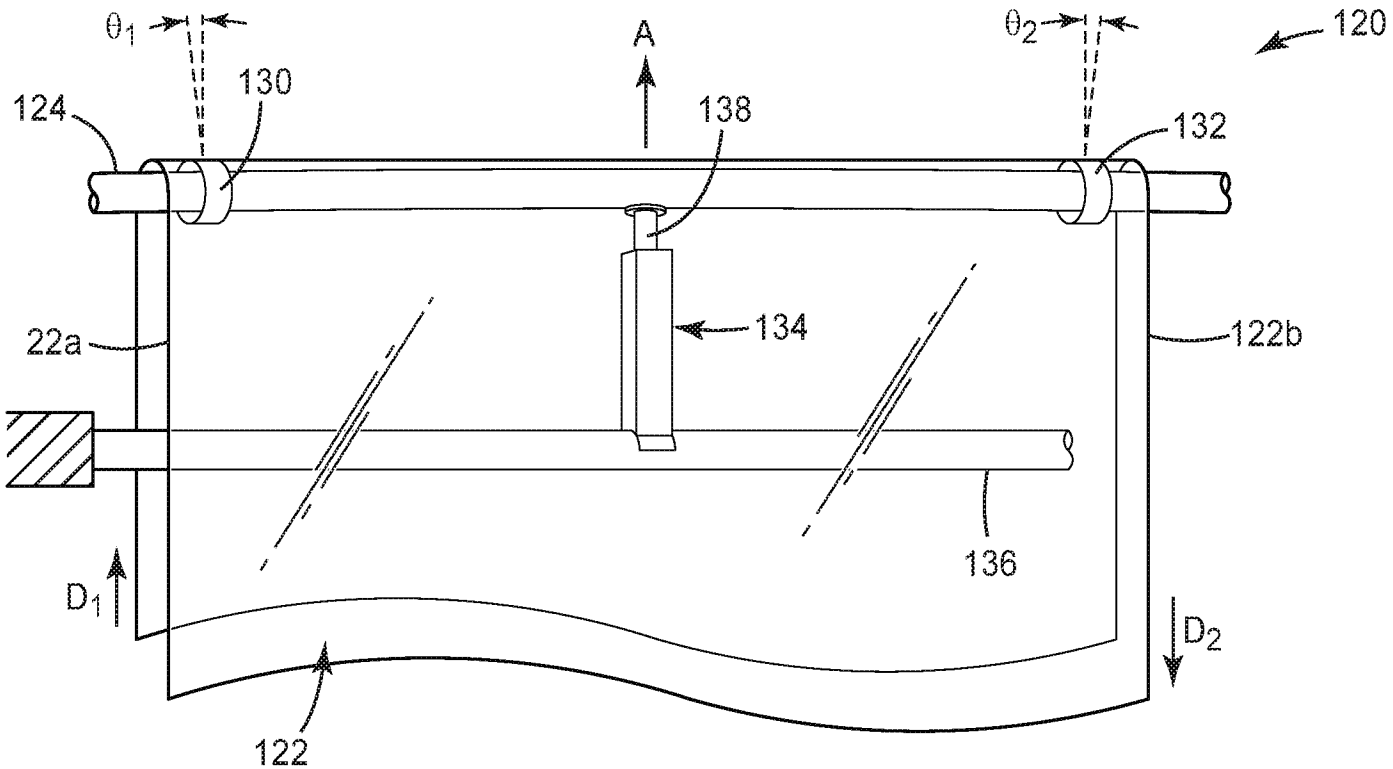
FIG. 2A is a schematic perspective view of an embodiment of a web handling apparatus.

In another embodiment of a portion of a web handling apparatus 120 depicted in FIG. 2A, a transparent web material 122 with a first edge 122*a* and second opposed edge 122*b* moves in a direction $D_1$. In this view, components of the web handling apparatus 120 that are shown through the transparent web material 122 are depicted with lines of lighter weight for visual clarity. A shaft 124 supports a first roller 130 and a second roller 132. The web material 122 moves over the surfaces of the rollers 130, 132, turns, and moves downstream of the rollers 130, 132 in a direction $D_2$. The shaft 124 is sufficiently bowed to cause at least one of the rollers 130, 132 to toe outwardly at an angle $\theta_1$ and $\theta_2$, respectively, with respect to the direction A to produce an optimum path for the web material 122. As noted above, it is not necessary that $\theta_1=\theta_2$, and $\theta_1$ and $\theta_2$ can be independently selected from greater than about 0° to about 6°, or greater than about 0 to about 2°, or greater than about 0° to about 1°, or about 0.2° to about 0.8°. The shaft 124 may be bowed using any suitable mechanical mechanism such as, for example, a push rod, a four-bar mechanism, a cam mechanism, and the like.

In the embodiment of FIG. 2A, a push rod 134, which is mounted on a support 136 and adjustable by a suitable mechanism such as a threaded bolt 138, engages the shaft 124 and moves the shaft 124 in the direction A. The "bowing" of the shaft 124 can be modified by adjusting the push rod 134.

Figure 2B:
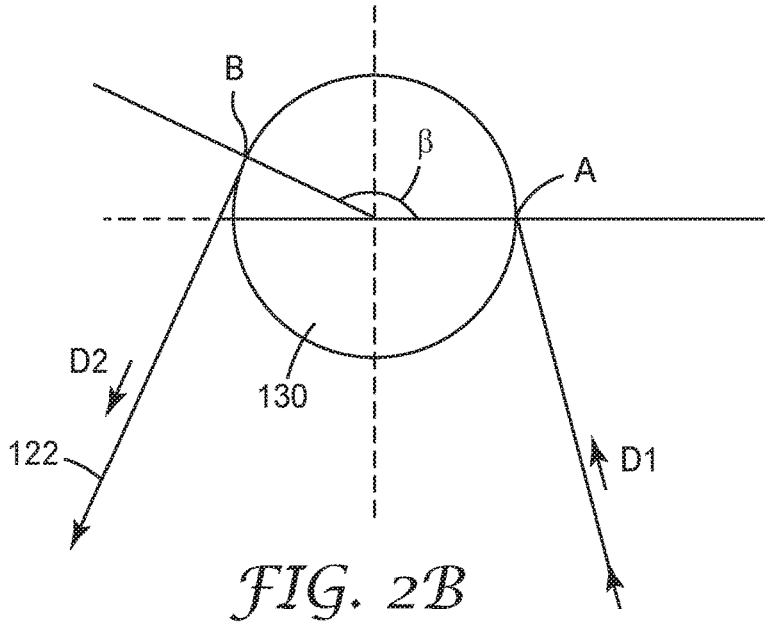
FIG. 2B is a schematic end view of a roller in a web handling apparatus.

Referring to FIG. 2B, the web material 122 can move in a direction D1, contact a roller 130 of FIG. 2A at a first point A, wrap at an angle β around the circumference of the roller 130, and then separate from the roller 130 at a point C to turn and move in a direction D2. In various embodiments, wrap angles of about 90° to about 230° have been found to be suitable, depending on the nature of the web material 122 and process conditions.

Figure 2C:
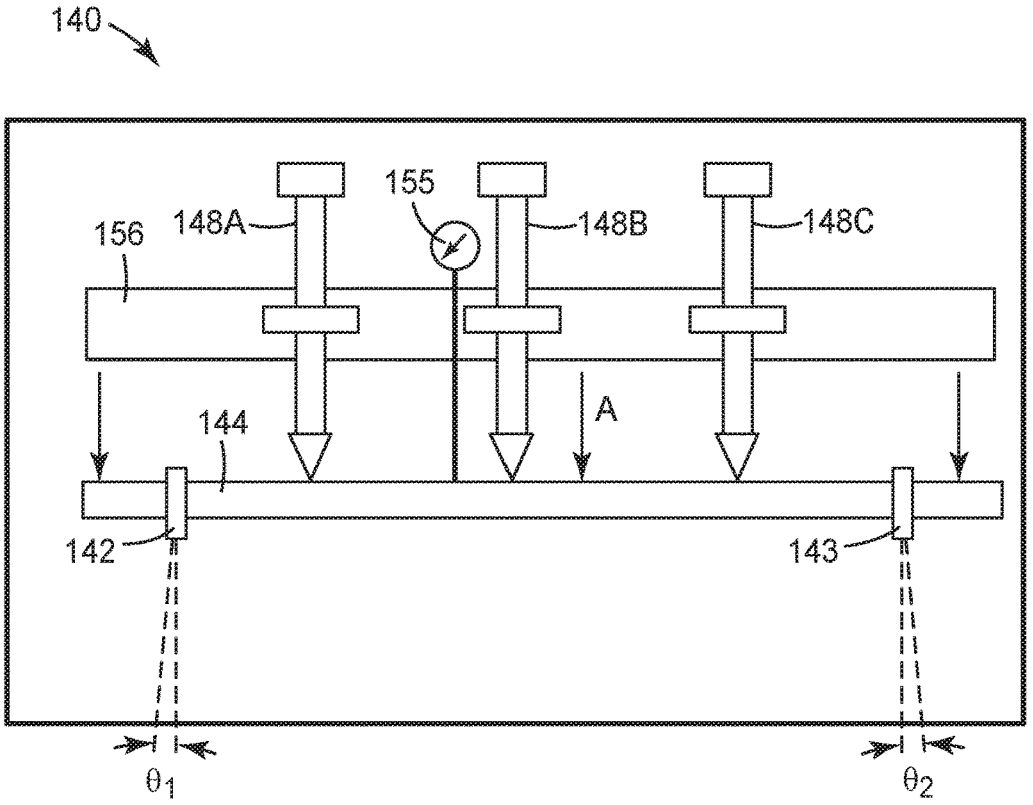
FIG. 2C is a schematic side view of an embodiment of a web handling apparatus.

In an alternative embodiment of a portion of a web handling system 140 shown in FIG. 2C, a support 156 has mounted thereon multiple threaded adjusting rods 148A, 148B, 148C. The threaded adjusting rods 148A-C exert force to bow a shaft 144 having mounted thereon at least two rollers 142, 143. Any or all of the threaded adjusting rods 148A-C may be adjusted to bow the shaft 144 in the direction of the arrow A, which in turn causes the at least one of the rollers 142, 143 to bow outwardly at an angle $\theta_1$ and $\theta_2$, respectively, with respect to the direction A to produce an optimum path for a web material (not shown in FIG. 2C) traversing the rollers 142, 143 along the direction A. An optional gauge 155 may be used to closely monitor the displacement of the shaft 144.

Figure 2D:
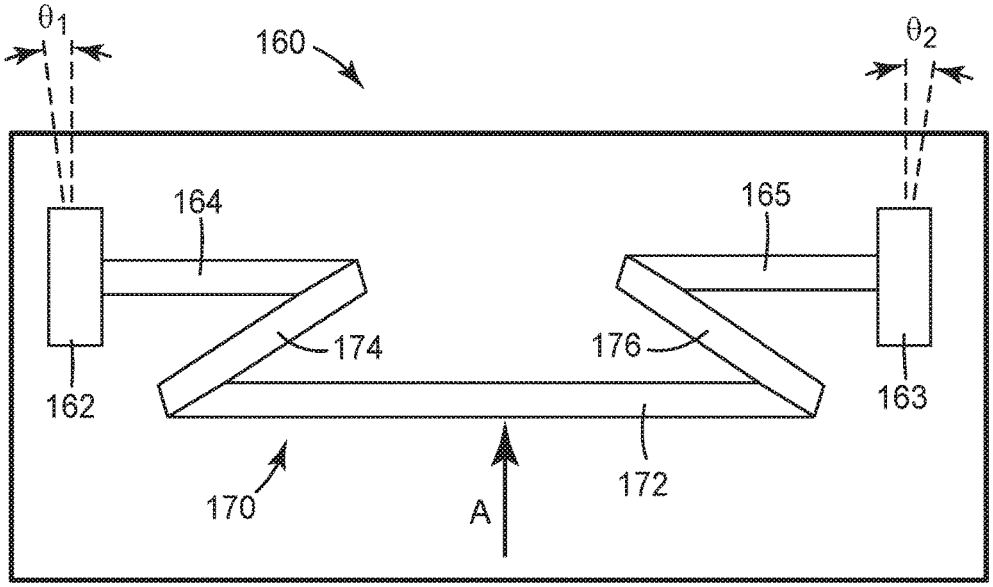
FIG. 2D is a schematic side view of an embodiment of a web handling apparatus.

In another embodiment of a portion of a web handling system 160 shown in FIG. 2D, rollers 162, 163 rotate about respective shafts 164, 165. When force is applied along the direction A against a central rod 172 of a triangulated rod linkage arrangement 170 that is substantially parallel to the shafts 164, 165, triangulated arms 174, 176 attached to the central rod 172 exert force on and bow the respective shafts 164, 165. The bowing shafts 164, 165 in turn cause the rollers 162, 163 mounted thereon to toe outwardly at an angle $\theta_1$ and $\theta_2$, respectively, with respect to the direction A to produce an optimum path for a web material (not shown in FIG. 2D) traversing the rollers 162, 163.

Figure 3:
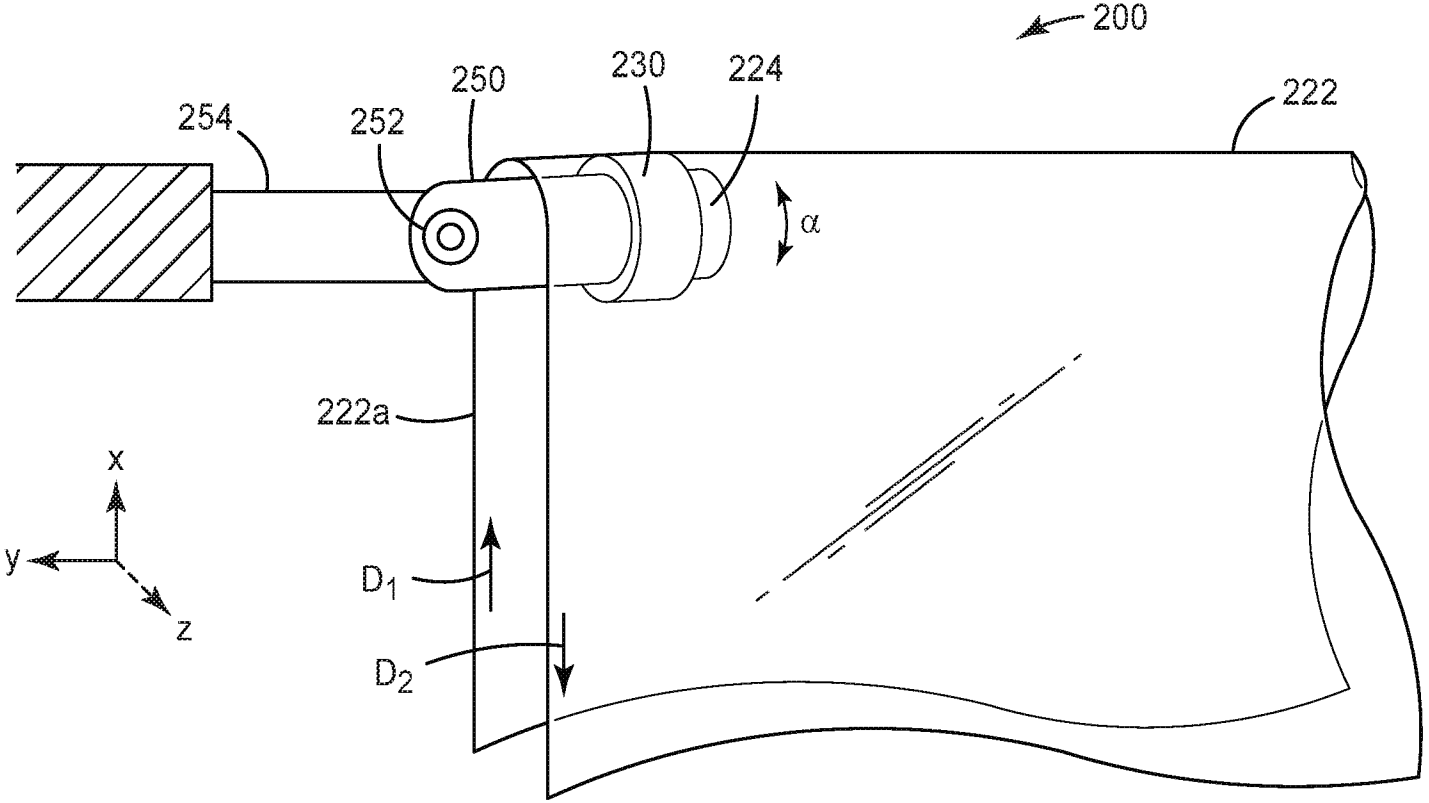
FIG. 3 is a schematic perspective view of an embodiment of a web handling apparatus.

In another embodiment shown in FIG. 3, a portion of a web handling apparatus 200 includes a roller 230 mounted on a shaft 224. The shaft 224 is mounted to or part of a roller support 250. The shaft 224 is angularly adjustable through a pivot point 252 between the roller support 250 and a structural mounting element 254. As shown schematically in FIG. 3, the shaft 224 can move through a wide range of angles α in a plane including a longitudinal axis of the shaft 224 along a direction y and a direction of travel x of a web material 222. In other embodiments not shown in FIG. 3, the shaft 224 could also be made angularly adjustable through a range of angles above or below the plane including the longitudinal axis y of the shaft 224 and the direction of travel x of the web material 222. As the shaft 224 is adjusted through the angles α, the angle of contact between the roller 230 mounted thereon and the web material 222 also changes, and the shaft 224 can be adjusted to produce a desired contact angle between the roller 230 and the web material 222. As shown in FIG. 3, the shaft 224 can be adjusted such that a portion of the web material 222*a* approaching the first contacting roller 230 and moving in direction $D_1$ upstream of the roller 230 turns about the roller 230 and moves in a direction D2 downstream of the roller 230 without wrinkling, creasing or bunching.

Figure 4:
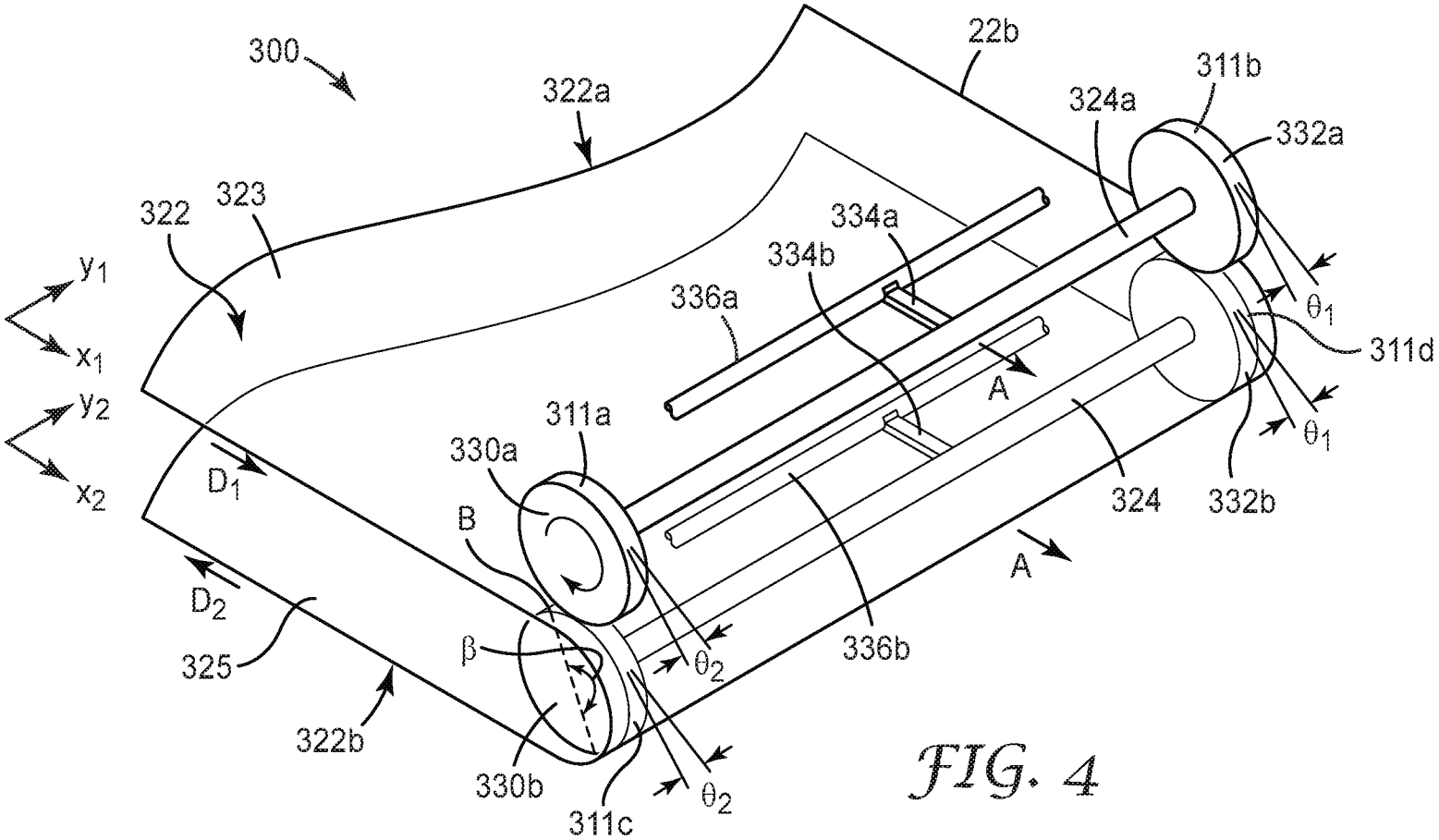
FIG. 4 is a schematic overhead view of an embodiment of a web handling apparatus.

Referring now to FIG. 4, another embodiment of a portion of a web handling apparatus includes a first set of rollers 330*a*, 332*a* rotating about a shaft 324*a*. A first adjustable push rod 334*a* is mounted on a first support 336*a*. The first adjustable push rod 334*a*, which is adjustable by a suitable mechanism such as a threaded bolt (not shown in FIG. 4, see FIG. 2A) engages the first shaft 324*a* and moves the first shaft 324*a* in the direction A. The first push rod 334*a* bows the first shaft 324*a* and causes at least one of the first set of rollers 330*a*, 332*a* to toe outwardly at an angle $\theta_1$ and $\theta_2$, respectively, with respect to the direction A to produce an optimum path for a web material 322. As noted above, it is not necessary that $\theta_1=\theta_2$, and $\theta_1$ and $\theta_2$ can be independently selected from greater than about 0° to about 6°, or greater than about 0 to about 2°, or greater than about 0° to about 1°, or about 0.2° to about 0.8°. The contact surfaces 311*a*, 311*b* of the first set of rollers 330*a*, 332*a* engage a first surface 323 of a first portion 322*a* of the web material 322 moving a direction $D_1$ in a first plane $x_1$-$y_1$, wherein the direction $y_1$ is aligned with a longitudinal axis of the shaft 324*a*.

The web material 322 passes through a nip between the first set of rollers 330*a*, 332*a* and a corresponding second set of rollers 330*b*, 332*b*, which rotate about a shaft 324*b*. A second adjustable push rod 334*b* is mounted on a second support 336*b*. The second adjustable push rod 334*b*, which is adjustable by a suitable mechanism such as a threaded bolt (not shown in FIG. 4, see FIG. 2A) engages the second shaft 324*b* and moves the second shaft 324*b* in the direction A. The second push rod 334*b* bows the second shaft 324*b* and causes at least one of the second set of rollers 330*b*, 332*b* to toe outwardly at an angle $\theta_1$ and $\theta_2$, respectively, with respect to the direction A to produce an optimum path for the nipped web material 322. As noted above, it is not necessary that $\theta_1=\theta_2$, and $\theta_1$ and $\theta_2$ can be independently selected from greater than about 0° to about 6°, or greater than about 0 to about 2°, or greater than about 0° to about 1°, or about 0.2° to about 0.8°. The contact surfaces 311*c*, 311*d* of the second set of rollers 330*b*, 332*b* engage a second surface 325, opposite the first surface 323, of the second portion 322*b* of the web material 322. The second portion 322*b* of the web material 322 turns and moves in a direction $D_2$ in a second plane $x_2$-$y_2$, wherein the direction $y_2$ is aligned with a longitudinal axis of the second shaft 324*b*.

As is clear from FIG. 4, the second plane $x_2$-$y_2$ lies below the first plane $x_1$-$y_1$. The web material 322, moving in the direction D1, contacts the roller 330*b* at a first point B, wraps at an angle β around the circumference of the roller 330*b*, and then separates from the roller 330*c* at a point C to turn and move in a direction D2. In various embodiments, wrap angles β of about 90° to about 230° have been found to be suitable, depending on the nature of the web material 322 and process conditions.

Figure 5A:
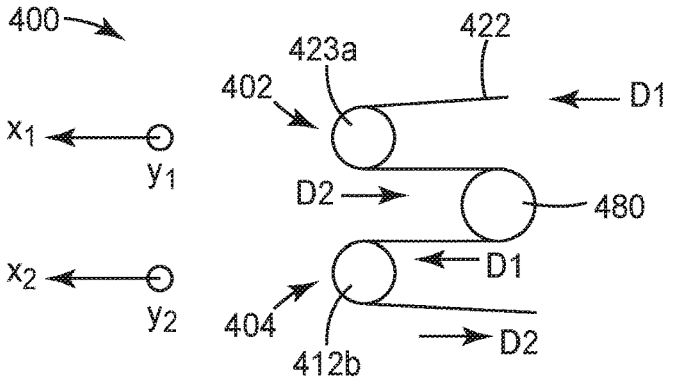
FIGS. 5A-5C are schematic side views of embodiments of web handling apparatus including idler rollers.
Figure 5B:
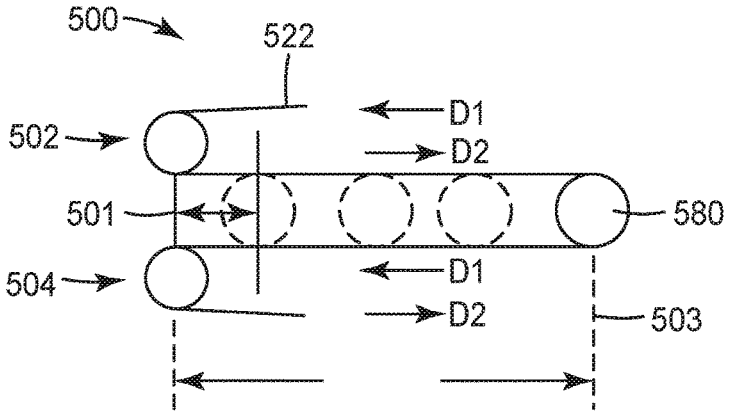
Figure 5C:
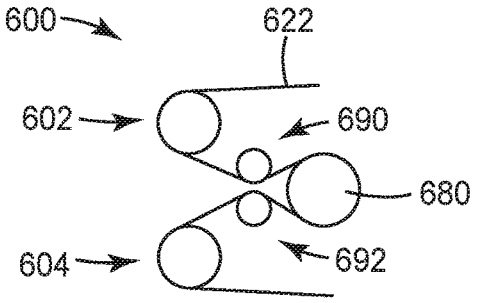

FIGS. 5A-5C illustrate embodiments of a web handling system 400 including alternative arrangements of idler rollers that can be used to change a direction of a web material. FIG. 5A is a schematic illustration of a first example of a portion of a web handling system 400 including a first set of rollers 402 in a first plane $x_1$-$y_1$ including a roller 412*a* and a roller 414*a* (not shown in FIG. 5A) rotating on a common shaft, and a second set of rollers 404 in a second plane $x_2$-$y_2$ below the first plane and including a roller 412*b* and a roller 414*b* (not shown in FIG. 5A) rotating on a common shaft, wherein a longitudinal axis of the shaft supporting the first set of rollers 402 is aligned along the direction $y_1$ and the a longitudinal axis of the shaft supporting the second set of rollers is aligned along the direction $y_2$. At least one of the rollers the first and second sets of rollers 402, 404 is "toed outward" and positioned at an angle θ with respect to a direction $x_1$ or $x_2$ as shown above in FIG. 4. In the embodiment of FIG. 5A, it is not necessary that the rollers 412*a*, 414*a* (not shown in FIG. 5A) in the first set of rollers 402 and the rollers 412*b*, 414*b* (not shown in FIG. 5A) in the second set of rollers 404 be toed out at the same angle, and the angle of tow for each roller in the set of rollers 402, 404 can be independently selected from greater than about 0° to about 6°, or greater than about 0 to about 2°, or greater than about 0° to about 1°, or about 0.2° to about 0.8°.

A web material 422 moves in a direction $D_1$, traverses the first set of rollers 402 and turns in a direction $D_2$ opposite the direction $D_1$. The web material 422 then traverses an idler roller 480 and again turns in the direction $D_1$ before traversing the second set of rollers 404. After traversing the second set of rollers 404, the web material 422 then again proceeds in the direction $D_2$.

As shown in FIG. 5B, a web handling system 500 includes a first set of rollers 502 and a second set of rollers 504 as described above in reference to FIG. 5A. In the web handling system 500 a distance r between a centerline 501 of the first set of rollers 502 and the second set of rollers 504 and a centerline 503 of the idler roller 580 can vary greatly depending on the intended application of the web handling system 500. For example, the a coating applied to the web material needs an extended processing time after traversing the first set of rollers 502 and prior to traversing the second set of rollers 504, the distance r between the rollers 502, 504 and the idler roller 580 can be correspondingly increased.

FIG. 5C illustrates an embodiment of a web handling system 600 including a first set of rollers 602 and a second set of rollers 604 as described above in reference to FIG. 5A. The web handling system 600 further includes a third set of rollers 690 and a fourth set of rollers 692 as described above in reference to FIG. 5A. The third and fourth sets of rollers 690, 692 lie in planes between the planes occupied by the first set of rollers 602 and the second set of rollers 604, and can be used, for example, to further tension a web material 622 before or after the web material 622 traverses an idler roller 680, or to more effectively pull the web material 622 around the idler roller 680.

The web handling apparatuses described above can be used in a wide variety of web material processing operations.

Figure 6:
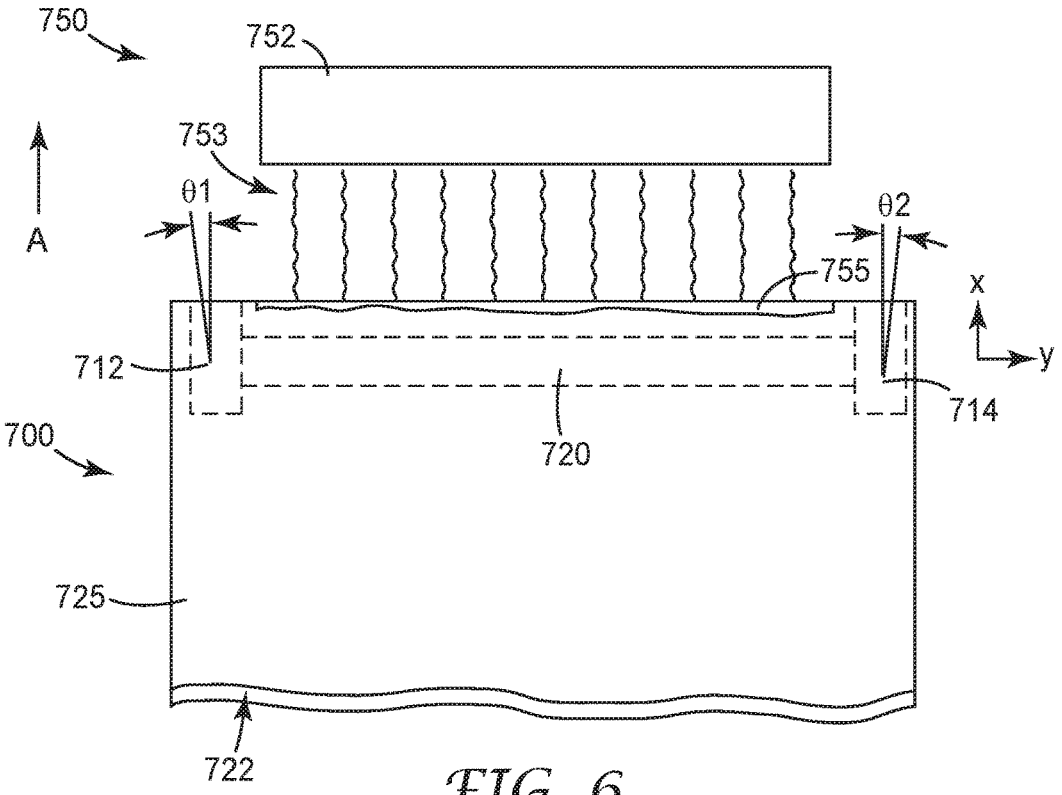
FIG. 6 is a schematic side view of a coating system including an embodiment of a web handling apparatus.
Figure 7:
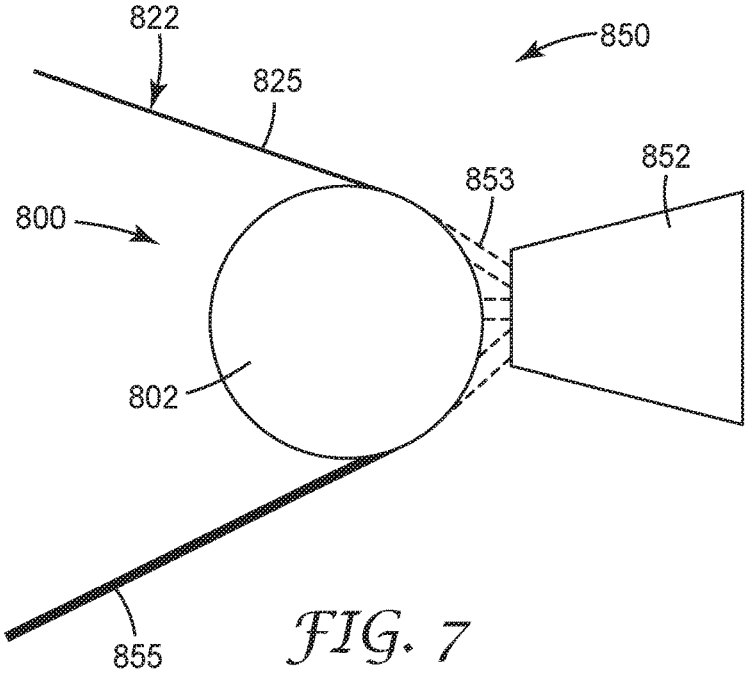
FIG. 7 is a schematic end view of a spray coating system including an embodiment of a web handling apparatus.

For example, a portion of a roll-to-roll web material processing system 750 depicted in FIG. 6 includes a web material handling apparatus 700 and a coating die 752. In the web handling apparatus 700, a web material 722 moves in a direction A and traverses an arrangement of rollers 712, 714. The rollers 712, 714 rotate about a shaft 720. At least one of the rollers 712, 714 is toed outward and positioned at an angle θ in a plane x-y with respect to a direction x normal to a longitudinal axis y of the shaft 720. In the embodiment of FIG. 7, the roller 712 is angled at an angle $\theta_1$ and the roller 714 is angled at an angle $\theta_2$ with respect to the direction x. In various embodiments, it is not necessary that $\theta_1=\theta_2$, and $\theta_1$ and $\theta_2$ can be independently selected from greater than about 0° to about 6°, or greater than about 0 to about 2°, or greater than about 0° to about 1°, or about 0.2° to about 0.8°. As the web material 722 traverses the rollers 712, 714, the coating die 752 deposits a coating composition 753 on a surface 725 of the web material 722 to form a coating layer 755 thereon.

In another example shown in FIG. 7, a roll-to-roll web material processing system 850 includes a web material handling apparatus 800 and a spray coater 852. The web handling system 850 includes a set of rollers 802 as described above in reference to FIG. 5A. As the web material 822 traverses the set of roller 802, the spray coater 852 deposits a coating composition 853 on a surface 825 of the web material 822 to form a coating layer 855 thereon. The processing system 850 shown schematically in FIG. 7 is particularly well suited to deposition of very thin coating layers 855 or deposition of coating compositions on very delicate web materials 822, or both. While not wishing to be bound by any theory, presently available evidence suggests that reducing the number and width of rollers underlying the web material 822 can reduce or substantially prevent damage to sensitive coatings or wrinkling and creases in very thin web materials.

Figure 8:
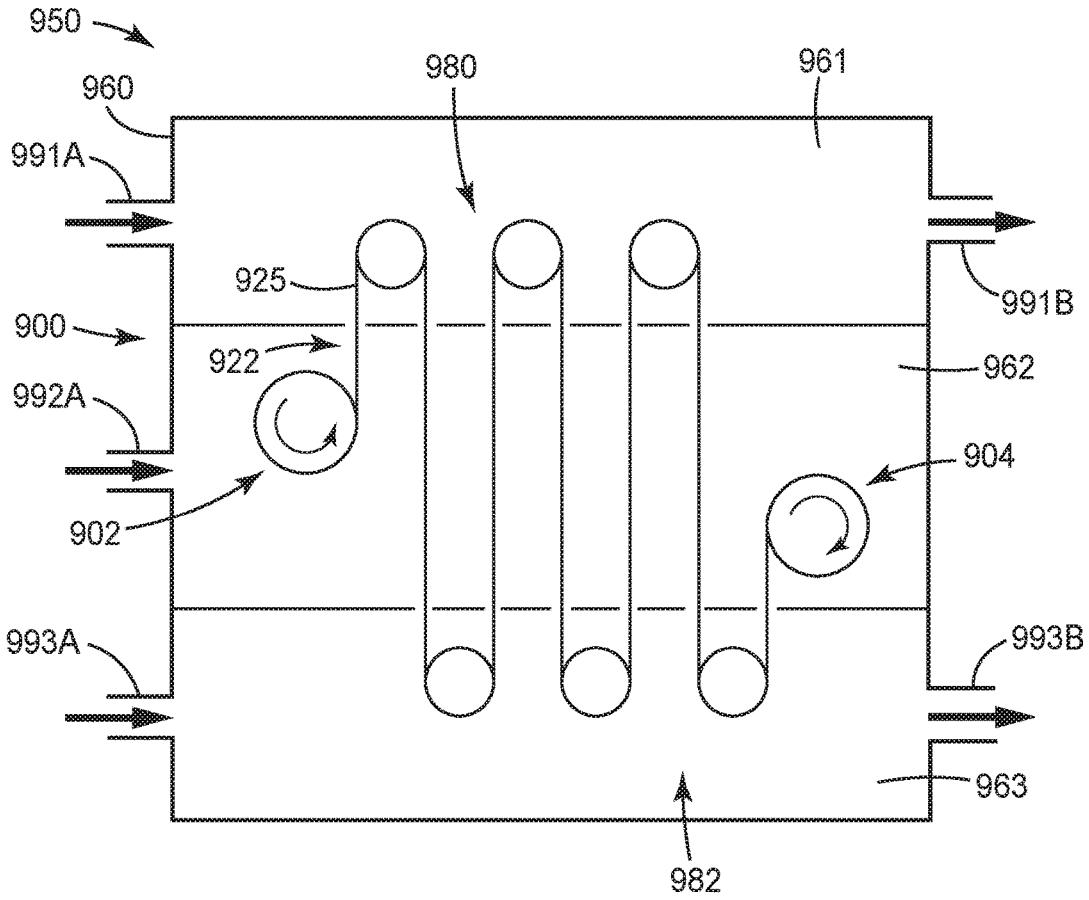
FIG. 8 is a web material processing system including an embodiment of a web handling apparatus.

In another example shown in FIG. 8, a roll-to-roll web material processing system 950 includes a web material handling apparatus 900 in a multi-chamber deposition apparatus 960. The web material handling apparatus 900 includes a first set of drive rollers 902 and a second set of drive rollers 904 as described above in reference to FIG. 5A. At least one roller in the first set of drive rollers 902 and the second set of drive rollers 904 is bowed outward at an angle selected from greater than about 0° to about 6°, or greater than about 0 to about 2°, or greater than about 0° to about 1°, or about 0.2° to about 0.8°. The web handling system 900 further includes a first set of idler rollers 980 and a second set of idler rollers 982, each arranged to turn a web material 922.

The deposition chamber apparatus 960 includes a first deposition chamber 961, a third deposition chamber 963, and a second deposition chamber 962 between the first deposition chamber 961 and the third deposition chamber 963. The deposition chambers 961, 962, 963 are substantially isolated from one another. The second deposition chamber houses the first set of drive rollers 902 and the second set of drive rollers 904. The first deposition chamber houses the first arrangement of idler rollers 980 and the third deposition chamber 963 houses the second arrangement of idler rollers 982.

In some embodiments, a first coating composition enters the first deposition chamber 961 at the first deposition chamber inlet 991A and exits the first deposition chamber outlet 991B. As the web material 922 enters the first deposition chamber 961, the first coating composition contacts a surface 925 of the web material 922 to form a coating layer thereon (not shown in FIG. 8). Following deposition of the first coating composition on the surface 925, the web material 922 then enters the second deposition chamber 962, which in some embodiments contains an inert gas input via a second deposition chamber inlet 992A. A second coating composition enters the third deposition chamber 963 at the third deposition chamber inlet 993A and exits the third deposition chamber outlet 993B. The web material enters the third deposition chamber 963 and the second coating composition is applied on the first coating layer forms a second coating layer overlying the first coating layer. The web material then traverses the second deposition chamber 962 and the first deposition chamber 961 a predetermined number of additional times before the completed coated article is wound up on the second set of rollers 904 in the second deposition chamber.

In another embodiment, the first coating composition and the second coating composition may react to form a coating layer on the surface 925.

In another embodiment, the web handling apparatuses described above may be useful in inspection systems. Since the rollers described herein used have a width that is narrow relative to the width of the web material, the web material is less likely to be distorted by contacting a wide roller or system of rollers, and debris on the rollers is less likely to contaminate the sample being inspected.

The web handling apparatuses described herein may be used to process web materials at a wide variety of web speeds from about 5 feet per minute (about 13 cm/sec) to about 3000 feet per minute (about 76 m/sec), and may be used in any surrounding medium including air, inert gases, water, vacuum and the like.

In some embodiments, a control system may optionally be used to control and/or maintain the toe out angle of the rollers.

The invention will now be described with reference to the following examples, which are not intended to be limiting.

EXAMPLE

In a web handling apparatus rollers with o-rings at an interface with a web material were spaced apart at intervals of 6, 8, 10, 12, and 14 inches (15, 20, 25, 30, and 36 cm) and used to transport the web material. A web tension was measured at each interval. The results are shown in the plot of FIG. 9.

In the same web handling apparatus, rollers without o-rings at the interface with the web material were spaced apart at the same intervals and used to transport the web material at the same speed. The rollers were toed out at an angle of about greater than about 0° to about 6°, or greater than about 0 to about 2°, or greater than about 0° to about 1°, or about 0.2° to about 0.8° as shown in FIG. 1. A web tension was again measured at each interval. The results are shown in the plot of FIG. 9.

Figure 9:
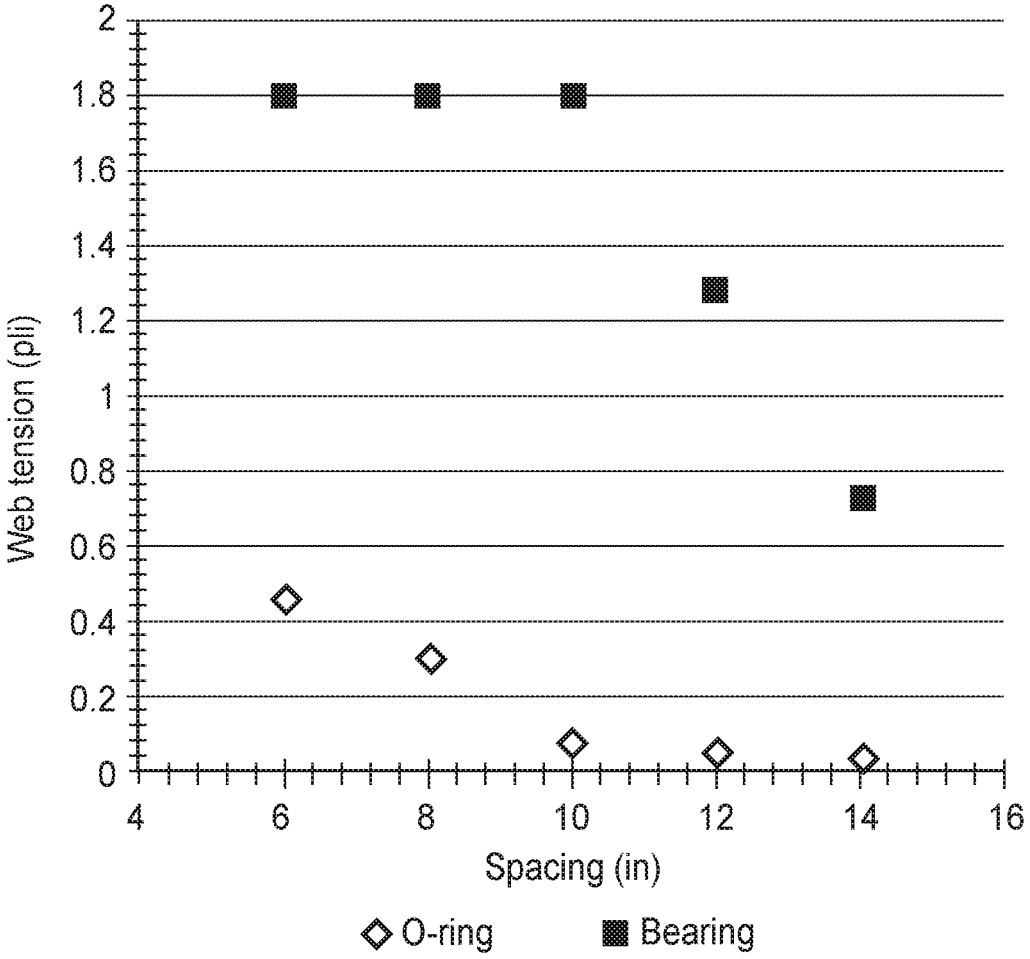
FIG. 9 is a plot of web tension vs. o-ring spacing and support roller spacing for the web handling apparatus of the Example.

The plots in FIG. 9 show that at large spacings the web tensions with the toed-out rollers in the web handling apparatus described herein are lower than the web tensions with conventional o-rings, and small contact area between the rollers and the web material could be of substantial value in preventing damage to thin or sensitive substrates.

Various embodiments of the invention have been described. These and other embodiments are within the scope of the following claims.

Embodiment A is directed to a web path for conveying a web material, including:

at least two support rollers contacting a single major surface of the web material, wherein the web material is of indefinite length and has a first and a second edge, the support rollers including:

a first support roller contacting a first edge region of the web material, and a second support roller contacting a second edge region of the web material, wherein the web material comprises an un-contacted region between the first and the second support roller comprising at least about 50% of the width of the web material;

and wherein at least one of the first support roller and the second support roller are supported on a bowed shaft such that at least one of the first and second support rollers is angled with respect to the direction of motion of the web.

Embodiment B is directed to the web path according to Embodiment A, wherein both of the first and second support rollers are angled with respect to the direction of motion of the web.

Embodiment C is directed to the web path according to Embodiments A or B, wherein the support rollers are at an angle θ in a plane x-y with respect to a direction x normal to a longitudinal axis y of the shaft, and wherein the angle θ is greater than about 0° and less than about 6°.

Embodiment D is directed to the web path according to Embodiment A, wherein the at least one roller is also angled with respect to a direction orthogonal to the direction of motion of the web.

Embodiment E is directed to the web path according to any of the preceding Embodiments A-D, wherein the wrap angle around at least one of the support rollers is about 90° to about 230°.

Embodiment F is directed to an apparatus for transporting a web material, the apparatus comprising:

least two support rollers, wherein:

a first support roller engages a first edge region of a first side of the web material having a length substantially greater than the width thereof, and a second support roller engages a second edge region of the first side of the web material, and wherein each of the rollers has a width that is substantially less than the width of the web material; and wherein each of the support rollers is rotatable on a bowed shaft, and wherein at least one of the support rollers is at an angle θ in a plane x-y with respect to a direction x normal to a longitudinal axis y of the shafts, and wherein the angle θ is greater than about 0° and less than about 6°.

Embodiment G is directed to the apparatus of Embodiment F, further comprising a triangulated linkage comprising a central rod substantially parallel to the shafts, and triangulated arms attached to the central rod and the shafts, and a push rod abutting the central rod to sufficiently bow the shafts along a direction x normal to a longitudinal axis y of the shafts such that at least one of the support rollers is at an angle θ in a plane x-y of greater than about 0° and less than about 6°.

Embodiment H is directed to the Embodiment F, wherein the angle θ is greater than about 0° and less than about 1°.

Embodiment I is directed to Embodiment F, wherein the first edge region and the second edge region comprise less than about 50% of the width of the web material.

Embodiment J is directed to Embodiment F, wherein the first edge region and the second edge region comprise less than about 20% of the width of the web material.

Embodiment K is directed to Embodiment F, wherein the web material wraps about the first roller and the second roller at an angle of about 90° to about 230°.

Embodiment L is directed to Embodiment F, wherein the first roller and the second roller are at the same angle θ.

Embodiment M is directed to a method, including:

engaging a first edge region on a first side of a web material with a first support roller, wherein the first support roller is rotatable on a first end of a shaft, and wherein the web material has a length substantially greater than the width thereof;

engaging a second edge region on the first side of the web material with a second support roller, wherein the second support roller is rotatable on a second end of the shaft opposite the first end thereof, and wherein a central region between the first roller and the second roller comprises at least about 80% of a width of the web material is free of support from a roller;

wrapping the web material about the first roller and the second roller at an angle of about 90° to about 230°; and orienting at least one of the support rollers at an angle θ in a first plane x-y with respect to a direction x normal to a longitudinal axis y of the shaft, wherein the angle θ is greater than about 0° and less than about 6°.

Embodiment N is directed to the method of Embodiment M, wherein the orienting the support rollers comprising bowing the shaft.

Embodiment O is directed to the method of Embodiment N, wherein orienting the support rollers comprises applying force by at least one push rod along the direction x to a portion of the shaft between the first and the second support rollers.

Embodiment P is directed to a method for coating a web material, the method comprising:

engaging a first edge region on a first side of the web material with a first support roller, wherein the first support roller is rotatable on a first end of a shaft, and wherein the web material has a length substantially greater than the width thereof;

engaging a second edge region on the first side of the web material with a second support roller, wherein the second support roller is rotatable on a second end of the shaft opposite the first end thereof, and wherein a central region comprising at least about 80% of a width of the web material between the first roller and the second roller is free of support from a roller;

bowing the shaft an amount sufficient to orient the first and the second support rollers at an angle θ in a first plane x-y with respect to a direction x normal to a longitudinal axis y of the shaft, wherein the angle θ is greater than about 0° and less than about 6°;

transporting the web material over the first and the second support rollers;

applying a coating composition to a second side of the web material opposite the first side; and processing the coating composition to form a coating layer on the second side of the web material.

Embodiment Q is directed to an apparatus for transporting a web material having a length substantially greater than the width thereof, the apparatus comprising:

a first support roller on a first end of a first shaft, wherein the first support roller engages a first edge region on a first side of the web material, and a second support roller on a second end of the first shaft, wherein the second support roller engages a second edge region on the first side of the web material, wherein a central region comprising at least about 80% of a width of the web material is unsupported by a roller; and wherein the first support roller and the second support roller are separated on the shaft a distance substantially equal to a width of the web material to be transported, and wherein at least one of the support rollers is at an angle θ in a first plane x-y with respect to a direction x normal to a longitudinal axis y of the shaft, and wherein the angle θ is greater than about 0° and less than about 6°.

Embodiment R is directed to the apparatus of Embodiment Q, further comprising a third support roller on a first end of a second shaft different from the first shaft, wherein the third support roller engages a first edge region of the web material on a second side of the web material opposite the first side thereof, and a fourth support roller on a second end of the second shaft, wherein the fourth second support roller engages a second edge region on the second side of the web material, wherein a central region comprising at least about 80% of a width of the web material is unsupported by a roller.

Embodiment S is directed to the apparatus of Embodiment Q, wherein the third support roller and the fourth support roller are in a second plane x-y different from the first plane, and wherein at least one of the third support roller and the fourth support roller is at an angle θ in the second plane with respect to a direction x normal to a longitudinal axis y of the second shaft, and wherein the angle θ is greater than about 0° and less than about 6°.

Embodiment T is directed to a web path for conveying a web material, comprising:

at least two support rollers contacting a single major surface of the web material, wherein the web material is of indefinite length and has a first and a second edge, and wherein the web material wraps about the support rollers at a wrap angle of about 90° to about 230°, the support rollers comprising:

a first support roller contacting a first edge region of the web material, and a second support roller contacting a second edge region of the web material opposite the first edge, such that the web material includes an un-contacted region between the first and the second support roller including at least about 50% of the width of the web material; and wherein at least one of the first support roller and the second support roller are angled with respect to the direction of motion of the web material.

Various embodiments of the invention have been described. These and other embodiments are within the scope of the following claims.

The invention claimed is:

1. A web path for conveying a web material, comprising:

at least two support rollers contacting a single major surface of the web material, wherein the web material is of indefinite length and has a first and a second edge, the support rollers comprising:

a first support roller contacting a first edge region of the web material, and a second support roller contacting a second edge region of the web material, wherein the web material comprises an un-contacted region between the first and the second support roller comprising at least about 50% of the width of the web material; and wherein at least one of the first support roller and the second support roller are supported on a bowed shaft such that at least one of the first and second support rollers is angled with respect to the direction of motion of the web material.

2. The web path according to claim 1, wherein both of the first and second support rollers are angled with respect to the direction of motion of the web.

3. The web path according to claim 1, wherein the support rollers are at an angle θ in a plane x-y with respect to a direction x normal to a longitudinal axis y of the shaft, and wherein the angle θ is greater than about 0° and less than about 6°.

4. The web path according to claim 1, wherein the at least one roller is also angled with respect to a direction orthogonal to the direction of motion of the web.

5. An apparatus for transporting a web material, the apparatus comprising:

least two support rollers, wherein:

a first support roller engages a first edge region of a first side of the web material having a length substantially greater than the width thereof, and a second support roller engages a second edge region of the first side of the web material, and wherein each of the rollers has a width that is substantially less than the width of the web material; and wherein each of the support rollers is rotatable on a bowed shaft, and wherein at least one of the support rollers is at an angle θ in a plane x-y with respect to a direction x normal to a longitudinal axis y of the shafts, and wherein the angle θ is greater than about 0° and less than about 6°.

6. The apparatus of claim 5, further comprising a triangulated linkage comprising a central rod substantially parallel to the shafts, and triangulated arms attached to the central rod and the shafts, and a push rod abutting the central rod to sufficiently bow the shafts along a direction x normal to a longitudinal axis y of the shafts such that at least one of the support rollers is at an angle θ in a plane x-y of greater than about 0° and less than about 2°.

7. The apparatus of claim 5, wherein the angle θ is greater than about 0° and less than about 1°.

8. The apparatus of claim 5, wherein the first edge region and the second edge region comprise less than about 50% of the width of the web material.

9. The apparatus of claim 5, wherein the first edge region and the second edge region comprise less than about 20% of the width of the web material.

10. The apparatus of claim 5, wherein the web material wraps about the first roller and the second roller at an angle of about 90° to about 230°.

11. The apparatus of claim 5, wherein the first roller and the second roller are at the same angle θ.

12. A web path for conveying a web material, comprising:

at least two support rollers contacting a single major surface of the web material, wherein the web material is of indefinite length and has a first and a second edge, and wherein the web material wraps about the support rollers at a wrap angle of about 90° to about 230°, the support rollers comprising:

a first support roller contacting a first edge region of the web material, and a second support roller contacting a second edge region of the web material opposite the first edge, such that the web material comprises an un-contacted region between the first and the second support roller comprising at least about 50% of the width of the web material; and wherein at least one of the first support roller and the second support roller are angled with respect to the direction of motion of the web.

13. A method, comprising:

engaging a first edge region on a first side of a web material with a first support roller, wherein the first support roller is rotatable on a first end of a shaft, and wherein the web material has a length substantially greater than the width thereof;

engaging a second edge region on the first side of the web material with a second support roller, wherein the second support roller is rotatable on a second end of the shaft opposite the first end thereof, and wherein a central region between the first roller and the second roller and comprising at least about 80% of a width of the web material is free of support from a roller; and wrapping the web material about the first roller and the second roller at an angle of about 90° to about 230'; and, orienting at least one of the support rollers at an angle θ in a first plane x-y with respect to a direction x normal to a longitudinal axis y of the shaft, wherein the angle θ is greater than about 0° and less than about 6°.

14. The method of claim 13, wherein the orienting the support rollers comprising bowing the shaft.

15. The method of claim 14, wherein orienting the support rollers comprises applying force by at least one push rod along the direction x to a portion of the shaft between the first and the second support rollers.

16. A method for coating a web material, the method comprising:

engaging a first edge region on a first side of the web material with a first support roller, wherein the first support roller is rotatable on a first end of a shaft, and wherein the web material has a length substantially greater than the width thereof;

engaging a second edge region on the first side of the web material with a second support roller, wherein the second support roller is rotatable on a second end of the shaft opposite the first end thereof, and wherein a central region comprising at least about 80% of a width of the web material between the first roller and the second roller is free of support from a roller;

bowing the shaft an amount sufficient to orient the first and the second support rollers at an angle θ in a first plane x-y with respect to a direction x normal to a longitudinal axis y of the shaft, wherein the angle θ is greater than about 0° and less than about 6°;

transporting the web material over the first and the second support rollers;

applying a coating composition to a second side of the web material opposite the first side; and processing the coating composition to form a coating layer on the second side of the web material.

* * * * *